US008251110B2

(12) United States Patent
Bassett et al.

(10) Patent No.: US 8,251,110 B2
(45) Date of Patent: Aug. 28, 2012

(54) FILLING ADAPTER

(75) Inventors: Wade Bassett, Albia, IA (US); Lisa L. Bassett, Albia, IA (US)

(73) Assignee: MBHD, LLC, Albia, IA (US)

( * ) Notice: Subject to any disclaimer, the term of this patent is extended or adjusted under 35 U.S.C. 154(b) by 1098 days.

(21) Appl. No.: 12/127,335

(22) Filed: May 27, 2008

(65) Prior Publication Data

US 2008/0223479 A1 Sep. 18, 2008

Related U.S. Application Data

(63) Continuation-in-part of application No. 10/919,975, filed on Aug. 17, 2004, now Pat. No. 7,726,521.

(51) Int. Cl.
*B65B 3/04* (2006.01)

(52) U.S. Cl. ..... 141/319; 141/364; 141/372

(58) Field of Classification Search ..... 141/319, 141/363–365, 370, 382

See application file for complete search history.

(56) References Cited

U.S. PATENT DOCUMENTS

| | | | | | |
|---|---|---|---|---|---|
| 952,495 | A | | 3/1910 | Austin | |
| 2,271,219 | A | | 1/1942 | Brunke | |
| 2,666,557 | A | * | 1/1954 | Hester | 141/288 |
| 2,724,535 | A | * | 11/1955 | Day et al. | 141/275 |
| 3,105,612 | A | | 10/1963 | Krasnoff | |
| 3,156,272 | A | * | 11/1964 | Indrunas | 141/286 |
| 3,266,533 | A | * | 8/1966 | McHale | 141/364 |
| 3,319,838 | A | | 5/1967 | Bayles | |
| 3,459,343 | A | | 8/1969 | Rasmussen | |
| 3,608,793 | A | | 9/1971 | Van LobenSels | |
| 3,615,150 | A | * | 10/1971 | Indrunas | 141/364 |
| 3,620,267 | A | * | 11/1971 | Seablom | 141/24 |
| 3,940,819 | A | | 3/1976 | Mc Mackin | |
| 3,945,617 | A | * | 3/1976 | Callery | 141/383 |
| 3,963,063 | A | * | 6/1976 | Pascarella | 141/309 |
| D243,731 | S | | 3/1977 | Donaldson | |
| 4,135,260 | A | | 1/1979 | Gresh | |
| 4,177,965 | A | | 12/1979 | Blaszkowski | |
| 4,201,252 | A | * | 5/1980 | Noel | 141/286 |
| 4,277,042 | A | | 7/1981 | Ash | |
| 4,286,407 | A | | 9/1981 | Adickes | |
| 4,309,014 | A | | 1/1982 | Blaszkowski | |
| 4,313,477 | A | * | 2/1982 | Sebalos | 141/301 |
| 4,347,879 | A | * | 9/1982 | Blaser | 141/364 |
| 4,397,050 | A | | 8/1983 | Davis | |
| 4,454,897 | A | * | 6/1984 | Valiant | 141/364 |
| 4,529,278 | A | | 7/1985 | Nugent | |
| 4,573,506 | A | * | 3/1986 | Paoletti | 141/98 |
| 4,582,227 | A | | 4/1986 | Kanfer | |
| 4,606,520 | A | | 8/1986 | Riniker | |
| 4,615,476 | A | | 10/1986 | Hobbs et al. | |
| 4,625,780 | A | * | 12/1986 | Burnham | 141/319 |
| 4,630,794 | A | | 12/1986 | Ross | |
| 4,651,902 | A | | 3/1987 | Hobbs et al. | |

(Continued)

*Primary Examiner* — Gregory Huson
*Assistant Examiner* — Nicolas A Arnett
(74) *Attorney, Agent, or Firm* — McKee, Voorhees & Sease, P.L.C.

(57) ABSTRACT

A filling adapter for conveying liquid from a first liquid container to a second liquid container is provided. The filling adapter includes an adapter body having a top end and an opposite button end, the top end adapted for fitting an opening in the first liquid container, the bottom end adapted for fitting an opening in the second liquid container, and an open path in the adapter body from the top end to the bottom end for communicating liquid from the opening in the first liquid container to the opening in the second liquid container.

38 Claims, 18 Drawing Sheets

U.S. PATENT DOCUMENTS 4,728,006 A 3/1988 Drobish
4,754,503 A 7/1988 Martin
4,771,272 A 9/1988 Barnes
4,775,124 A 10/1988 Hicks
D304,791 S 11/1989 De Vigili
4,938,346 A 7/1990 Urbano
4,945,598 A 8/1990 Racioppi
4,951,533 A 8/1990 Hillinger
4,982,874 A 1/1991 Pringle
5,011,316 A 4/1991 Damon
5,014,860 A 5/1991 Emery
5,028,026 A 7/1991 Philipps
5,031,258 A 7/1991 Shaw
5,071,387 A 12/1991 Pottick
5,177,829 A 1/1993 Simpson
5,220,949 A * 6/1993 Rufenacht ..... 141/285
5,230,648 A 7/1993 Kelley
5,232,189 A 8/1993 Koch
5,238,106 A 8/1993 Nguyen
5,243,931 A 9/1993 Mc Donough
5,264,145 A 11/1993 French
5,279,576 A * 1/1994 Loo et al. ..... 604/187
5,312,018 A 5/1994 Evezich
5,318,202 A 6/1994 D'Andrade
5,404,598 A 4/1995 Hadsell
5,490,545 A * 2/1996 Sokoloff et al. ..... 141/319
5,509,529 A 4/1996 Kelley
5,534,228 A * 7/1996 Wesseler ..... 422/541
5,546,614 A 8/1996 King
5,548,853 A 8/1996 Johnson
5,625,908 A 5/1997 Shaw
5,655,999 A 8/1997 Drew
5,665,580 A * 9/1997 Crooke et al. ..... 435/375
5,680,929 A 10/1997 Von Seidel
5,690,096 A 11/1997 Burch
5,704,078 A 1/1998 Chandler
5,757,275 A 5/1998 Mowry
5,772,079 A 6/1998 Gueret
5,810,201 A 9/1998 Besse
5,850,945 A 12/1998 Frankel
5,857,594 A 1/1999 Ozturk
5,865,325 A 2/1999 Comstock
5,884,678 A * 3/1999 Chudy ..... 141/319
5,894,611 A 4/1999 Toro
5,918,650 A * 7/1999 Borden ..... 141/383
5,920,926 A 7/1999 Torres
5,966,752 A 10/1999 Abugideiri
6,010,683 A 1/2000 Fischer
6,065,649 A * 5/2000 Scoggins ..... 141/364
6,076,223 A 6/2000 Dair
6,092,772 A 7/2000 Garcia
6,116,045 A 9/2000 Hodosh
D431,971 S * 10/2000 Hatton ..... D7/619.1
6,139,820 A 10/2000 Fischer
6,141,816 A 11/2000 Burnett
6,152,294 A 11/2000 Weinberg
6,182,720 B1 * 2/2001 Barnoski et al. ..... 141/375
6,237,649 B1 * 5/2001 Moisio et al. ..... 141/100
6,260,590 B1 * 7/2001 Ziegmann ..... 141/332
6,296,024 B1 * 10/2001 Oestreich ..... 141/364
6,314,592 B1 11/2001 Stein
6,315,163 B1 11/2001 Shu
6,330,948 B1 12/2001 Leto
6,341,508 B1 1/2002 Minassian
6,363,739 B1 4/2002 Hodosh
6,382,439 B1 * 5/2002 Belokin et al. ..... 215/228
6,457,190 B1 10/2002 Stein
6,481,239 B2 11/2002 Hodosh
6,530,502 B2 3/2003 Neal
D480,608 S * 10/2003 Haslam, Sr. ..... D7/619.1
6,669,033 B1 12/2003 Lian
6,745,802 B2 * 6/2004 Varga ..... 141/319
6,945,417 B2 * 9/2005 Jansen et al. ..... 141/329
6,966,530 B2 11/2005 Hsu
7,210,508 B2 * 5/2007 Behar ..... 141/329
7,302,976 B1 * 12/2007 Bultman ..... 141/364

* cited by examiner

FILLING ADAPTER

CROSS-REFERENCE TO RELATED APPLICATIONS

The present application is a Continuation-in-Part of and claims priority to U.S. patent application Ser. No. 10,919,975 filed Aug. 17, 2004, herein incorporated by reference in its entirety.

BACKGROUND OF THE INVENTION

The present invention relates to the dispensement of liquids. More particularly, but not exclusively, the present invention relates to a filling adapter.

Liquid dispensers that incorporate push pumps are found in various places throughout the home, including in the kitchen and bathroom. These liquid dispensers can be used for dispensing soap, lotion, condiments, or other types of liquid. Liquid dispensers for dispensing liquids are often preferred over alternatives because liquid dispensers are generally cleaner and create less mess than alternatives.

Another problem related to liquid dispensing is that containers of liquid are often discarded prior to the containers being fully empty. For a variety of reasons, the last of a liquid is often difficult to remove from the container. For example, where a pump is used to pump the liquid, the intake piping could not normally reach the bottom of the container. Liquids with greater viscosity may be more difficult to pump and liquids may stick to the side of the liquid container which also makes them more difficult to pump. Therefore, what is needed is an improved filling adapter.

Thus, it is a primary object, feature, or advantage of the present invention to improve upon the state of the art.

These and/or other objects, features or advantages of the present invention will become apparent from the specification and claims. The present invention is not to be limited by these objects, features, or advantages.

SUMMARY OF THE INVENTION

According to one aspect of the invention, a filling adapter for conveying liquid from a first liquid container to a second liquid container is provided. The filling adapter includes an adapter body having a top end and an opposite button end, the top end adapted for fitting an opening in the first liquid container, the bottom end adapted for fitting an opening in the second liquid container, and an open path in the adapter body from the top end to the bottom end for communicating liquid from the opening in the first liquid container to the opening in the second liquid container.

According to another aspect of the present invention, a method for filling a first liquid container is provided. The method includes operatively connecting a first end of filling adapter to the first liquid container, operatively connecting a second end of the filling adapter to a second liquid container, and elevating the second liquid container relative to the first liquid container to induce gravity flow of a liquid in the first liquid container into the second liquid container.

According to another aspect of the present invention, a system is provided. The system includes a liquid container comprising a body having an inner cavity for containing the liquid and an aperture providing access to the inner cavity and a filling adapter for filling the liquid dispenser, the filling adapter comprising a first end adapted for fitting to the aperture of the liquid container and a second end adapter for fitting to an opening of a second liquid container.

DETAILED DESCRIPTION OF THE PREFERRED EMBODIMENT

The present invention relates to a filling adapter. The filling adapter may be used with any number of liquid containers, which may be used in any number of different environments, and any number of types of liquids.

Figure 1A:
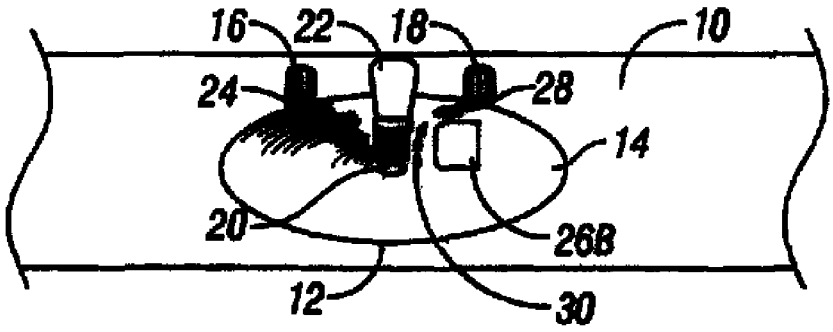
FIG. 1A is a view of a liquid dispenser of the present invention removeably attached to the inside of a sink.

The liquid can be, without limitation, soap, shampoo, gel, foam, hair care liquid, a cleaning liquid, or an edible liquid (such as various condiments). FIG. 1A illustrates a bathroom countertop 10. A sink 12 is positioned within the bathroom countertop 10. The sink 12 has an inside surface 14. The inside surface 14 of the sink is typically contoured or sloped inwardly from the countertop 10 to the drain 20 or otherwise ellipsoidally shaped, although the adjustability of the liquid dispenser of the present invention allows it to accommodate a number of different types of sinks or other surfaces. The fixtures 16 and 18 are also shown. These fixtures are used for controlling hot and cold water. Also, a faucet 22 is shown. Water 24 is shown flowing from the faucet 22 to the drain 20. A liquid dispenser 26B is shown with a push pump 28 for pumping, in this case, liquid soap 30 from the dispenser 26B. The present invention fully contemplates that other types of liquids can be dispensed, including but not limited to lotions, hair care products, etc.

Figure 1B:
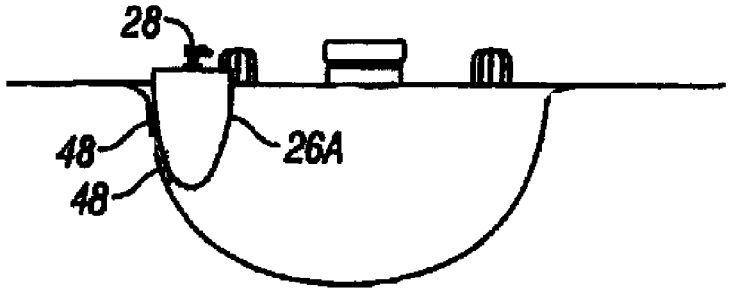
FIG. 1B is a sectional view of a liquid dispenser of the present invention removeably attached to the inside of a sink showing the body of the liquid dispenser conforming to the ellipsoidal surface of the sink.

FIG. 1B illustrates a sectional view of a liquid dispenser 26A placed in a sink having an ellipsoidal shape. The liquid dispenser 26A is attached to the sink through suction cups 48. The liquid dispenser 26A conformingly fits the ellipsoidally shaped sink.

Figure 1C:
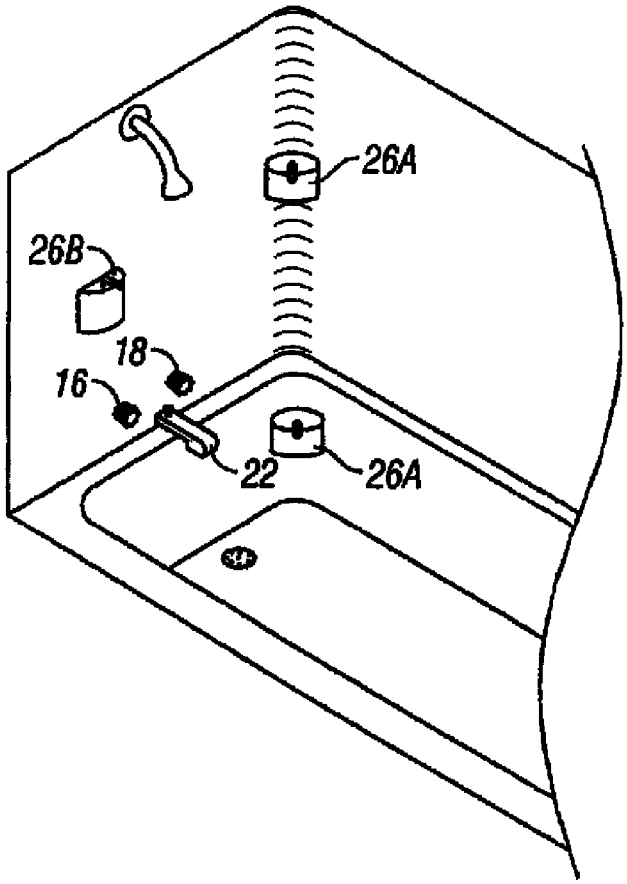
FIG. 1C is a perspective view of multiple liquid dispensers mounted in a bath area.

FIG. 1C illustrates a perspective view of liquid dispensers 26A and 26B in a bath area. The liquid dispensers (26A, 26B) can be placed in the bath tub, on the walls of a shower, or elsewhere.

Figure 1D:
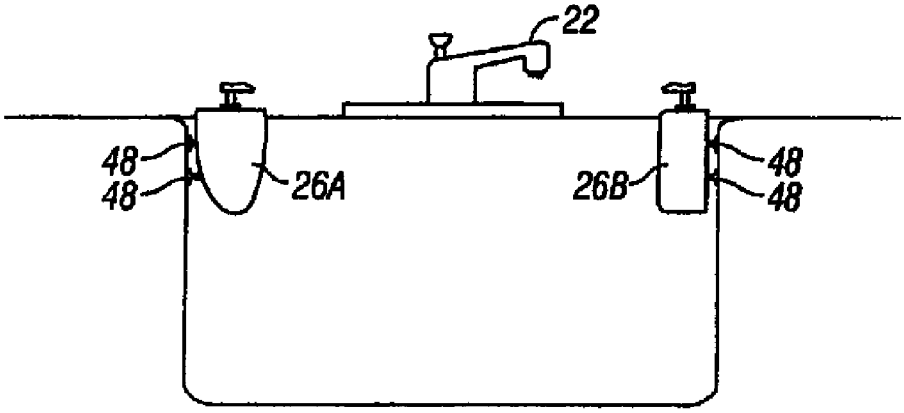
FIG. 1D is a sectional view of multiple liquid dispensers mounted in a sink.

FIG. 1D illustrates a sectional view of a kitchen sink with liquid dispensers 26A and 26B. The sink is generally rectangular in nature. The suction cups 48 of each liquid dispenser (26A, 26B) are preferably adjusted to fit against the surface of the walls of the sink.

Figure 2A:
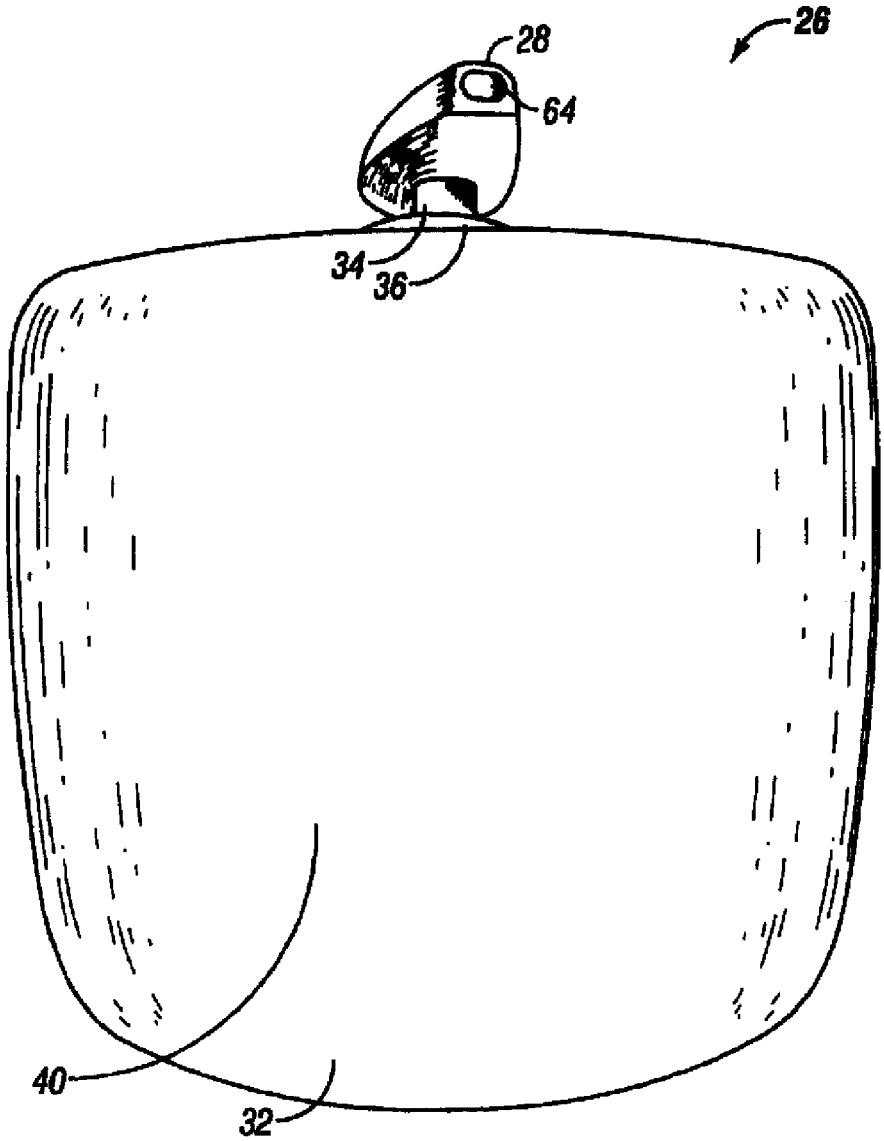
FIG. 2A is a front perspective view of one embodiment of a liquid dispenser according to the present invention.
Figure 2B:
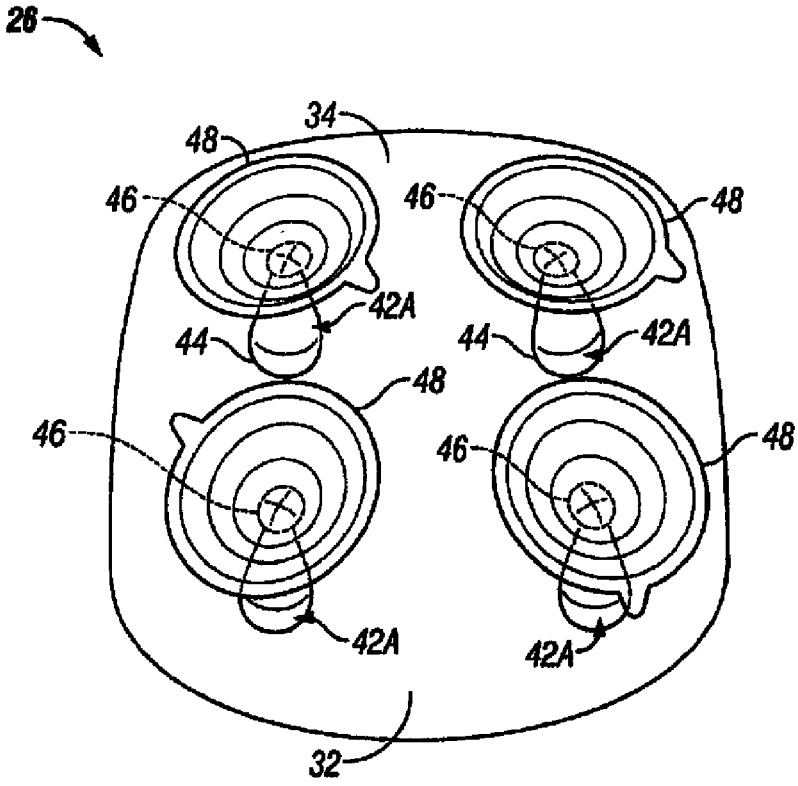
FIG. 2B is a rear perspective view of one embodiment of a liquid dispenser according to the present invention.

FIG. 2A illustrates a front perspective view of a liquid dispenser 26. The liquid dispenser 26 has a dispenser body 32 that forms an inner cavity for containing liquid. The dispenser 26 has a removable pump 28. A shoulder 36 and a neck 34 of the push pump 28 are used for dispensing liquids from within the dispenser body 32. The push pump 28 includes an outlet 64 from which liquid is dispensed. The dispenser 26 has a front surface or side 40 shown in FIG. 2A. FIG. 2B illustrates an opposite side of the dispenser 26. Other types of pumps can be used, including but not limited to, full stroke, low-profile, adjustable stroke, short stroke, electric, electronic activation, etc.

In FIG. 2B, the dispenser body 32 is shown. A neck 34 of the dispenser body 32 can extend downwardly into the dispenser body 32. A plurality of apertures 42A are shown. Suction cups 48 are adapted to fit within the apertures 42A. The apertures 42A have a larger opening portion 44 and a smaller opening portion 46. This allows the suction cups 48 to be inserted into the larger portion 44 of the aperture and then slid to the smaller portion 46 of the aperture in order to be secured. Other means for securing or fastening the suction cups 48 to the dispenser body 32 can be used, including permanent attachment. The suction cups 48 can be adjustable or fixed in various embodiments.

Figure 2C:
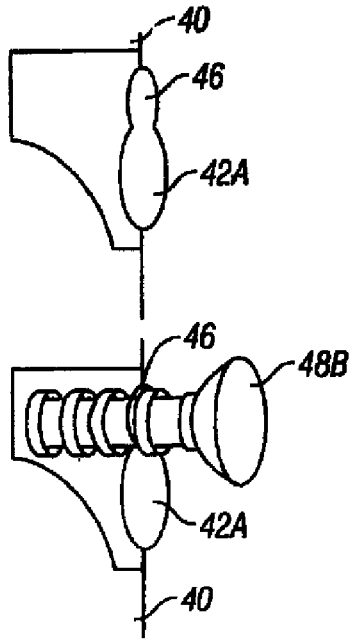
FIG. 2C is a sectional view showing openings in the dispenser body for receiving suction cups with an adjustable suction cup fitted within one of the openings.

FIG. 2C illustrates how a suction cup can be removeably connected to a back surface 40 of a liquid dispenser. There is at least one opening 42A for accepting a suction cup 48B. The opening 42A allows a suction cup 48B to be placed in the opening 42A and then the suction cup 48B can be secured by sliding it into the smaller opening 46.

Figure 3A:
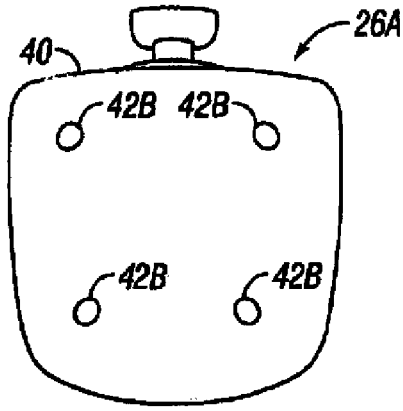
FIG. 3A is a rear view of one embodiment of the dispenser body showing openings for receiving suction cups.
Figure 3B:
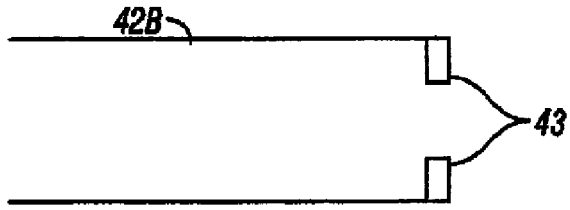
FIG. 3B is a sectional view of one embodiment of an opening in the dispenser body for receiving a suction cup.
Figure 3C:
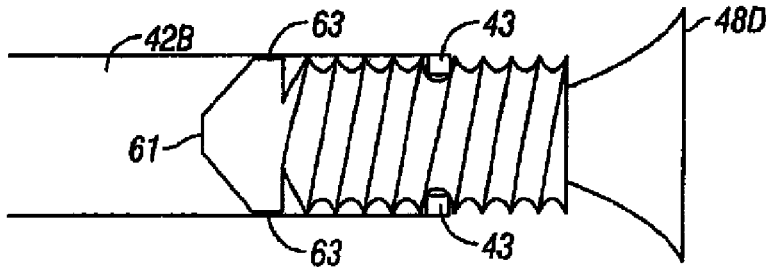
FIG. 3C is a sectional view of one embodiment of an opening in the dispenser body for receiving a suction cup with a suction cup inserted.

FIGS. 3A-3C illustrate another embodiment of apertures 42B of a liquid dispenser 26A. There is a retainer 43 associated with the apertures 42B for matingly connecting with threads of the suction cup 48D. FIG. 3C shows head 61 making suction cup 48D less likely to be removed from apertures 42B once inserted into apertures 42B. Preferably the shape of the head 61 helps prevent the removal of the head 61 by a child. Preferably the head 61 is shaped to include an outer wall 63 so as to tightly fit within the aperture 42B and increase contact between the head 61 and the dispenser body. This type of configuration of the head 61 also provides more rigidity to the suction cups in the fully extended outward position. If child safety is not an issue, then remove ability could be achieved by eliminating the head area.

Figure 4A:
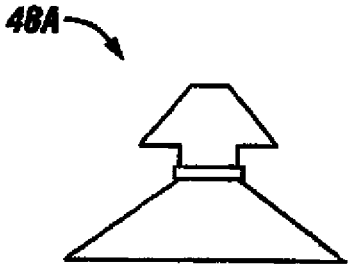
FIG. 4A is a front view of one embodiment of a suction cup according to the present invention.
Figure 4B:
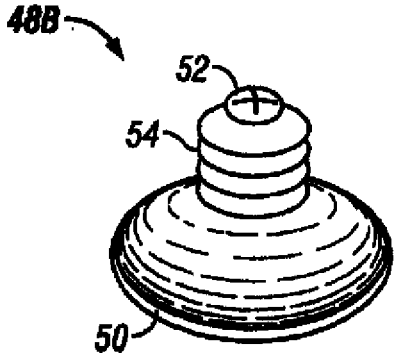
FIG. 4B is a perspective view of one embodiment of a height adjustable suction cup according to the present invention.
Figure 4C:
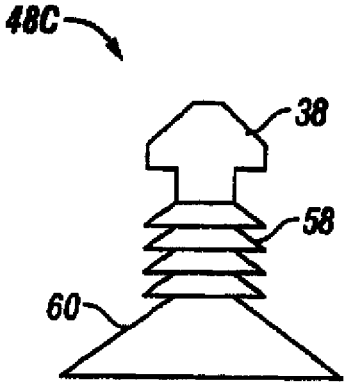
FIG. 4C is a front view of another embodiment of a height adjustable suction cup according to the present invention.
Figure 4D:
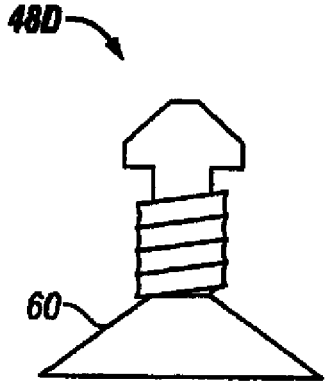
FIG. 4D is a front view of yet another embodiment of a height adjustable suction cup according to the present invention.

FIGS. 4A-4D illustrate exemplary embodiments of suction cups. FIG. 4A illustrates a typical suction cup 48A. FIGS. 4B-4D illustrate various embodiments of adjustable suction cups. In FIG. 4B, the suction cup 48B has a base 50. In addition, the suction cup 48B has a neck 54 that extends upwardly from the base 50. There is a screw 52 through the top portion of the neck 54 that is used to adjust the height of the suction cup 48B. The neck 54 of the suction cup 48B can include a plurality of segments that can be added or removed to alter the height of the suction cup 48B. Alternatively, the neck 54 can be compressed through tightening the screw 52, or the suction cup 48B can otherwise be adjusted in height. Another method for using the suction cup 48B of FIG. 4B is to simply insert the neck 54 into an opening 46 (see FIG. 2C) to the desired height. This may result in some of the segments extending above and/or below the opening 46 shown in FIG. 2C.

The suction cup 48B can also be of permanent multiple segments rigid enough to span and support the desired fully adjusted position. The screw 52 is optional. Where used it provides additional rigidity and stability and allows for the addition of segments. The present invention contemplates that rigidity and stability can be increased in alternative ways as well.

FIG. 4C illustrates another embodiment of an adjustable suction cup 48C of the present invention. In FIG. 4C, the suction cup 48C has a base 60 opposite a top end 38. There are a plurality of segments 58 between the base 60 and the top end 38. The segments 58 can be compressed or expanded against one another in order to lower or raise the height of the suction cup 48C. The height of suction cup 48C is adjusted by expanding and collapsing the segments 58. The suction cups can be height adjusted prior to insertion into the dispenser body. Adjustability can be accomplished by inserting a suction cup into a round aperture located in the back of the body. The suction cup can be pushed in until the proper number of segments are inserted for proper mounting. Threaded necks on the suction cups can also be placed in the round aperture until the desired distance is reached.

FIG. 4D illustrates suction cup 48D having a base 60. Suction cup 48D is a threaded suction cup. This allows the useable height of the suction cup 48D to be altered, especially when used in the embodiment shown in FIGS. 3A-3C. The suction cup 48D is merely screwed into or out of an aperture of the dispenser body in order to adjust the height of the suction cup 48D.

Because the suction cups are height adjustable, the dispenser body 32 of FIG. 2A can be more easily and conveniently adapted for use within a particular environment. For example, when the dispenser body 32 is to be inserted into the inside surface of a sink, the inside surface of the sink is often curved or contoured or sloped. The suction cups may be height adjusted so that the dispenser body can be secured to the inside surface of the sink in a manner that allows the dispenser body to be placed against or parallel with the surface of the sink. This results in the dispenser body being better secured to the sink, results in the dispenser body taking a smaller amount of space so as not to inconvenience those who use the sink. Although described in the context of a sink, the same device (or other conforming designs) can be used in a bathtub or shower or other environment. Also, the conforming design may be inserted to a base that can change the shape of the back of the liquid dispenser. This filler would make the conforming design better adaptable and more appealing in various applications. Various designs and logos may be placed on the dispenser such as character shapes, inserted pictures or objects, printed pictures, animals on the pump, sound effects, talking, different colors and materials, etc.

Figure 4E:
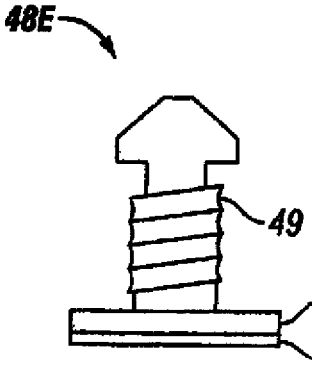
FIG. 4E is a front view of yet another embodiment of a height adjustable mounting means according to the present invention.

Other means of mounting a liquid dispenser can be used. The type of mount need not be limited to suction cups. One alternative embodiment is shown in FIG. 4E. The mounting means 48E is similar in appearance to the suction cup of FIG. 4D. The means of adjusting 49 of FIG. 4E can be accomplished in any number of ways, including by any of the previously discussed designs in FIGS. 4A-4D. Instead of having a suction cup base, however, there is a base 65 with adhesive pad 67 attached to the base 65. The adhesive pad 67 is mountable to a surface. The adhesive pad 67 is strong enough to support the weight of the liquid dispenser and preferably is waterproof to accommodate mounting in sinks, showers, baths, or other environments where water is a concern. Although it is preferred that either a suction cup or an adhesive pad is used, other types of mounting means are used. Preferably such mounting means are easily removable and reattachable.

Figure 5A:
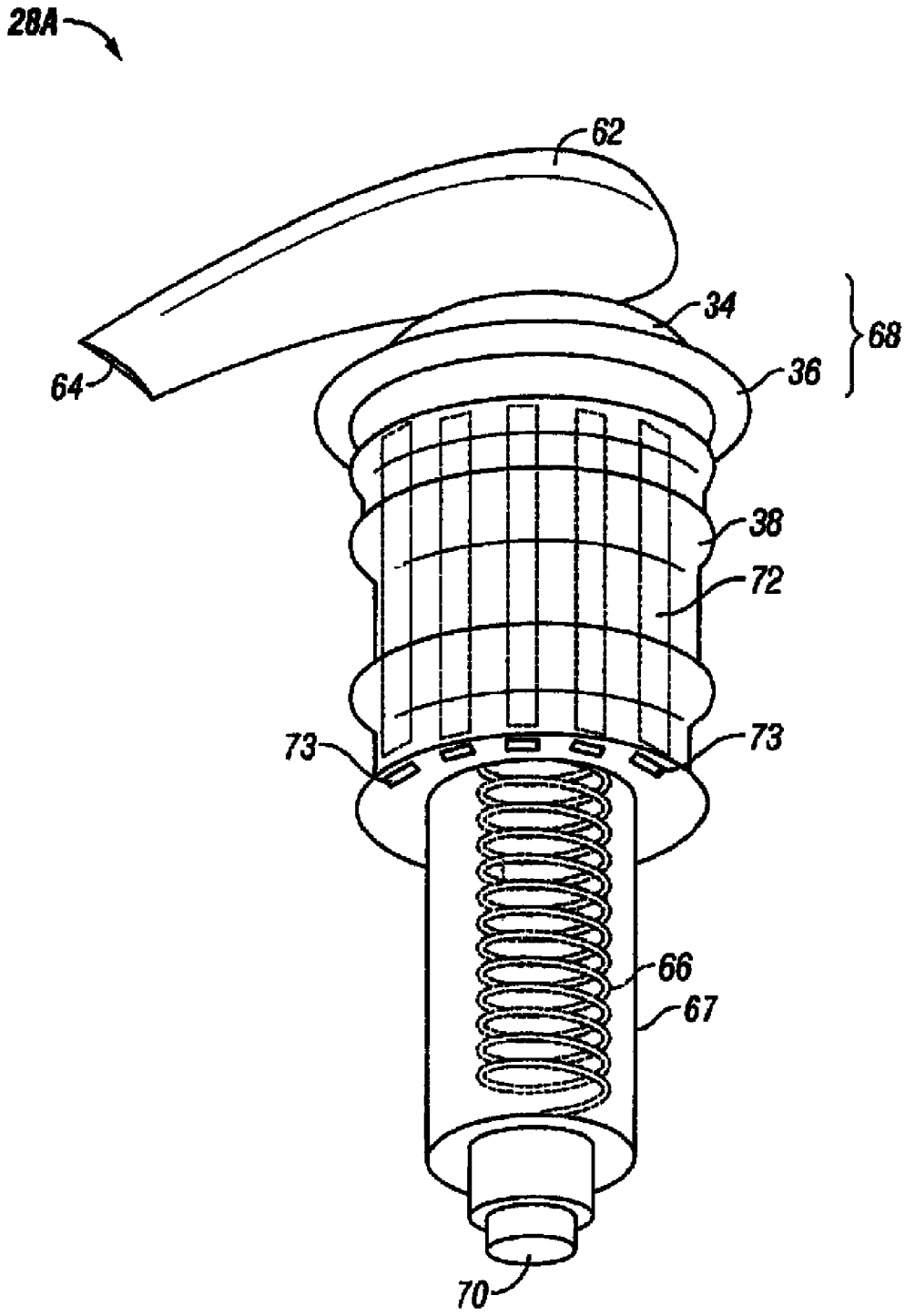
FIG. 5A is a perspective view of a push pump used in one embodiment of a liquid dispenser of the present invention.

FIGS. 5A-5E illustrates various embodiments of a push pump. In FIG. 5A, the push pump includes a neck 34 and a shoulder 36. The neck 34 can extend above the dispenser body. The shoulder 36 rests against the dispenser body. The push pump fits within the dispenser body. One method of attaching the push pump to the dispenser body is by securing it with thread 38. Preferably, the push pump 28A has a short stroke 68 to provide a compact pump assembly. The push pump 28A shown has an inside spring 66 and a piston pump area 67. An inlet 70 for the dispenser body is shown and an outlet 64 is shown on the pump head 62. Liquid, such as soap, is drawn through the inlet 70 and is secreted through the outlet 64. There are a plurality of air passages 72 shown that improve the push pump's ability to pump by venting the inner cavity from opening 73 to the atmosphere out the neck 34. Any number of other variations in the design of the pump or dispenser body for functional or aesthetic purposes. Preferably, the pump is threaded as shown to allow for a more compact design. Compactability can also be provided through other means. For example, including through the design of the screw-on extendable neck. The piston diameter can be increased to decrease the stroke. The size of the extendable neck can be decreased. A push-on and lock type push pump can be used. The neck length on the pump head can be reduced. The present invention contemplates that all of these as well as other methods can be used to improve the compactness of the device.

Figure 5B:
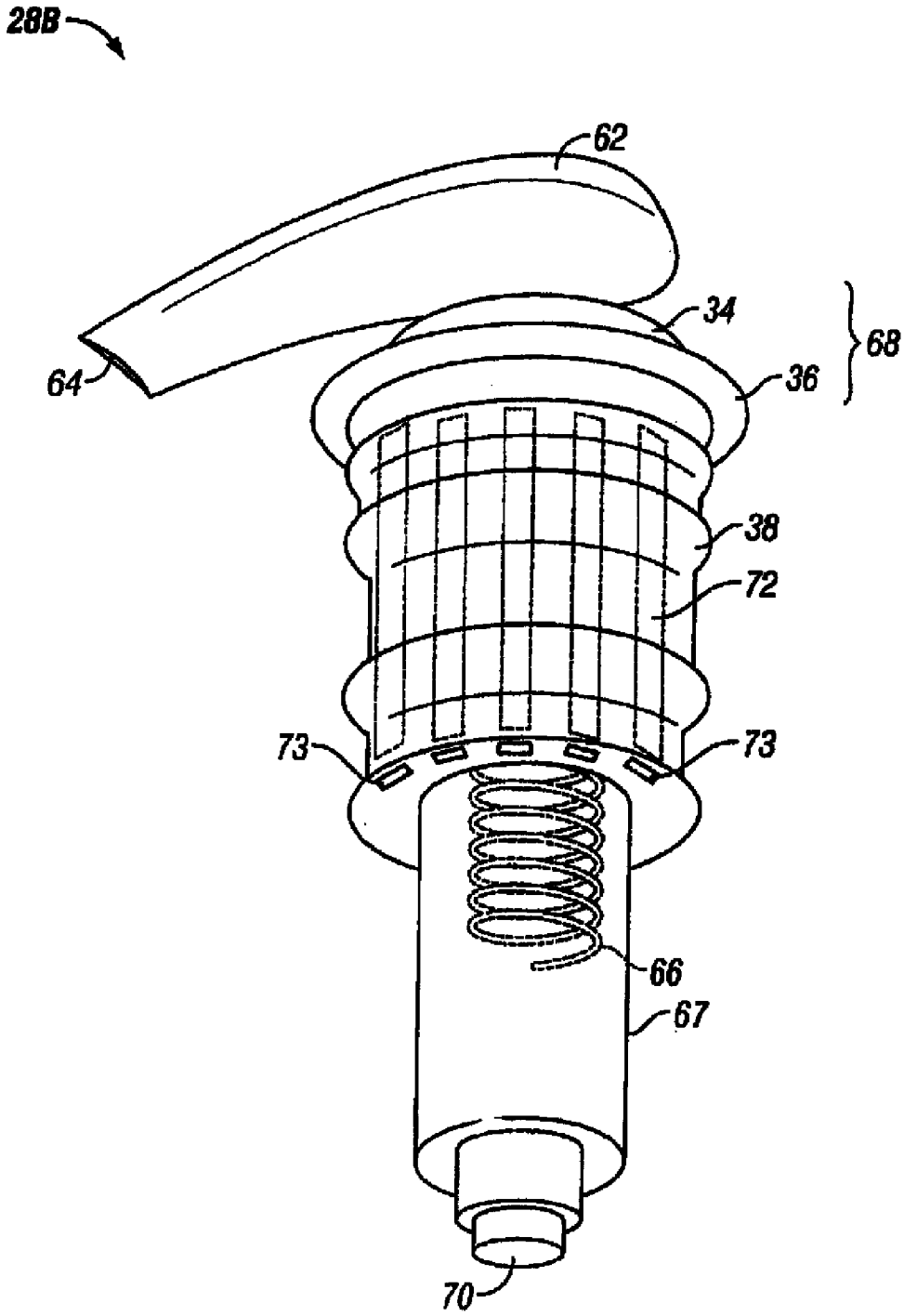
FIG. 5B is a perspective view of another embodiment of a push pump having a shorter spring to decrease output per pumping stroke.

In contrast to FIG. 5A, FIG. 5B illustrates a push pump 28B with a shorter spring 66 that decreases the output of liquid through outlet 64 when the pump head 62 is pumped. The shorter spring 66 decreases the output of liquid by causing a shorter stroke when the pump head 62 is pushed downward. This configuration may be desirable when children use the dispenser in order to decrease the possibility of a mess. However, the output of liquid can be immediately increased by pulling the pump head 62 up before pushing down on it to dispense liquid. Therefore, if an adult or other user needs more soap, the output of liquid can be increased without needing to change the spring 66 to a longer length.

Figure 5C:
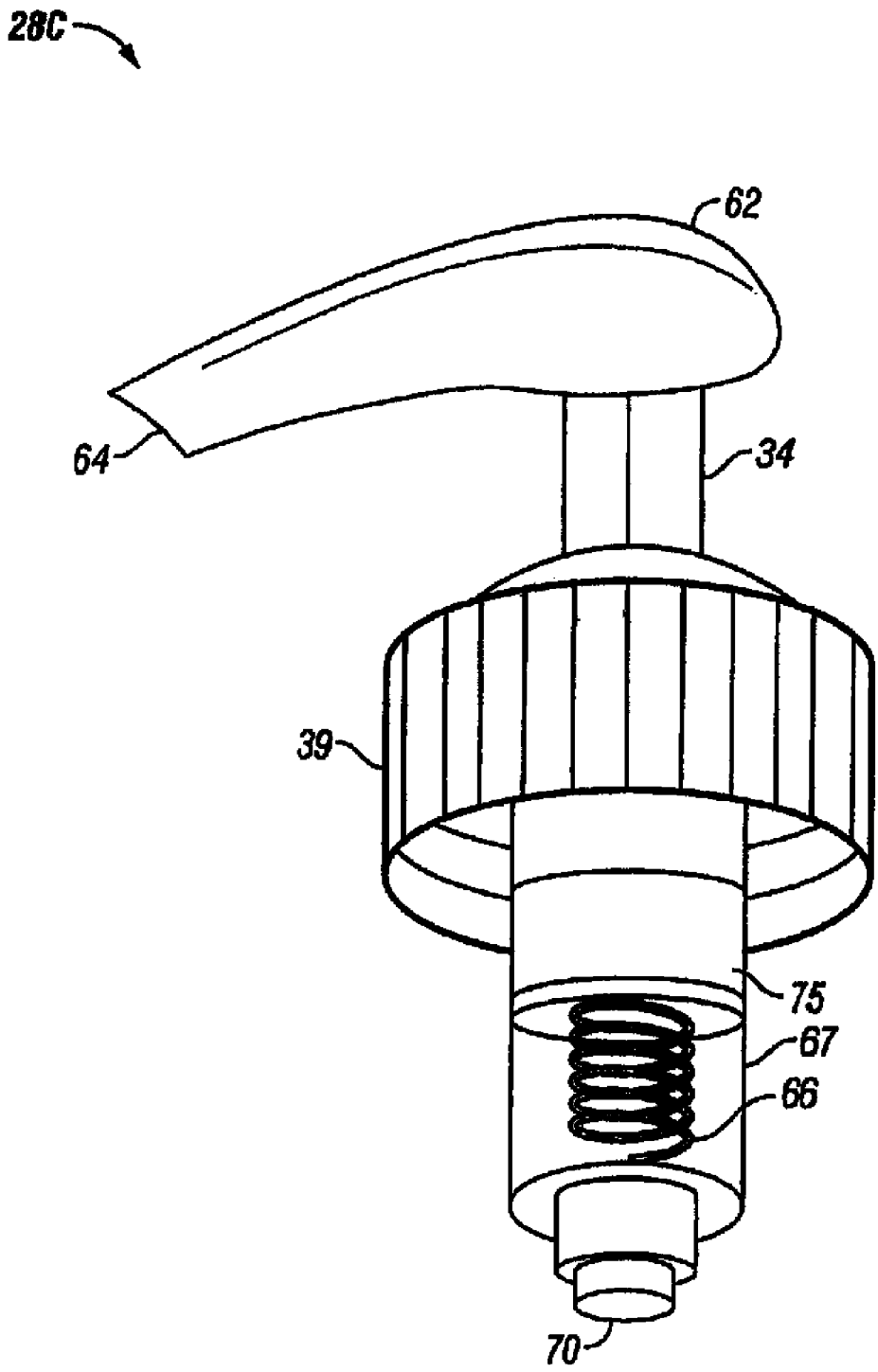
FIG. 5C is a perspective view of an embodiment of an adjustable output push pump illustrating a stop member that can be positioned to vary output.
Figure 5D:
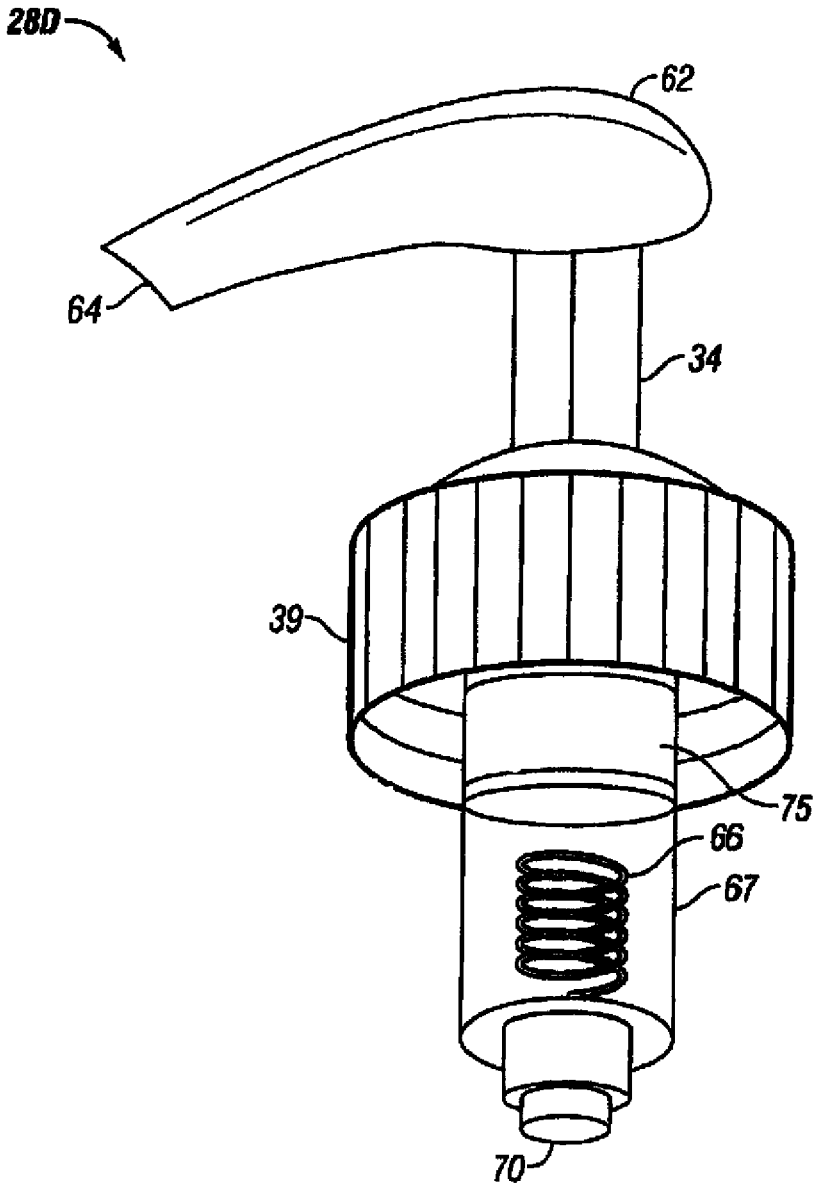
FIG. 5D is a perspective view of another embodiment of an adjustable output push pump illustrating a longer stroke that can be obtained by raising the stop member.

Referring to the push pump 28C of FIG. 5C, an alternative means of regulating the output of liquid per pumping stroke is shown. A stop member 75 is positioned within piston pump area 67. The stop member can be positioned at various points within piston pump area 67 in order to regulate the amount of liquid that dispenses through outlet 64 during a pumping stroke. If stop member 75 is positioned closer to inlet 70, the spring 66 is compressed to a shorter length which results in a shorter pumping stroke and decreases the amount of liquid secreted through outlet 64 during a pumping stroke. Alternatively, as in FIG. 5D, the push pump 28D includes a stop member 75 that can be positioned closer to pump head 62 which allows the spring 66 to expand. A longer spring length increases the length of the pumping stroke and increases the amount of liquid secreted through outlet 64 during a pumping stroke. In order to maximize output of liquid per pumping stroke in this embodiment, the stop member 75 should be positioned as close as possible towards the pump head 62 so the spring 66 is allowed to expand to its maximum length.

Figure 5E:
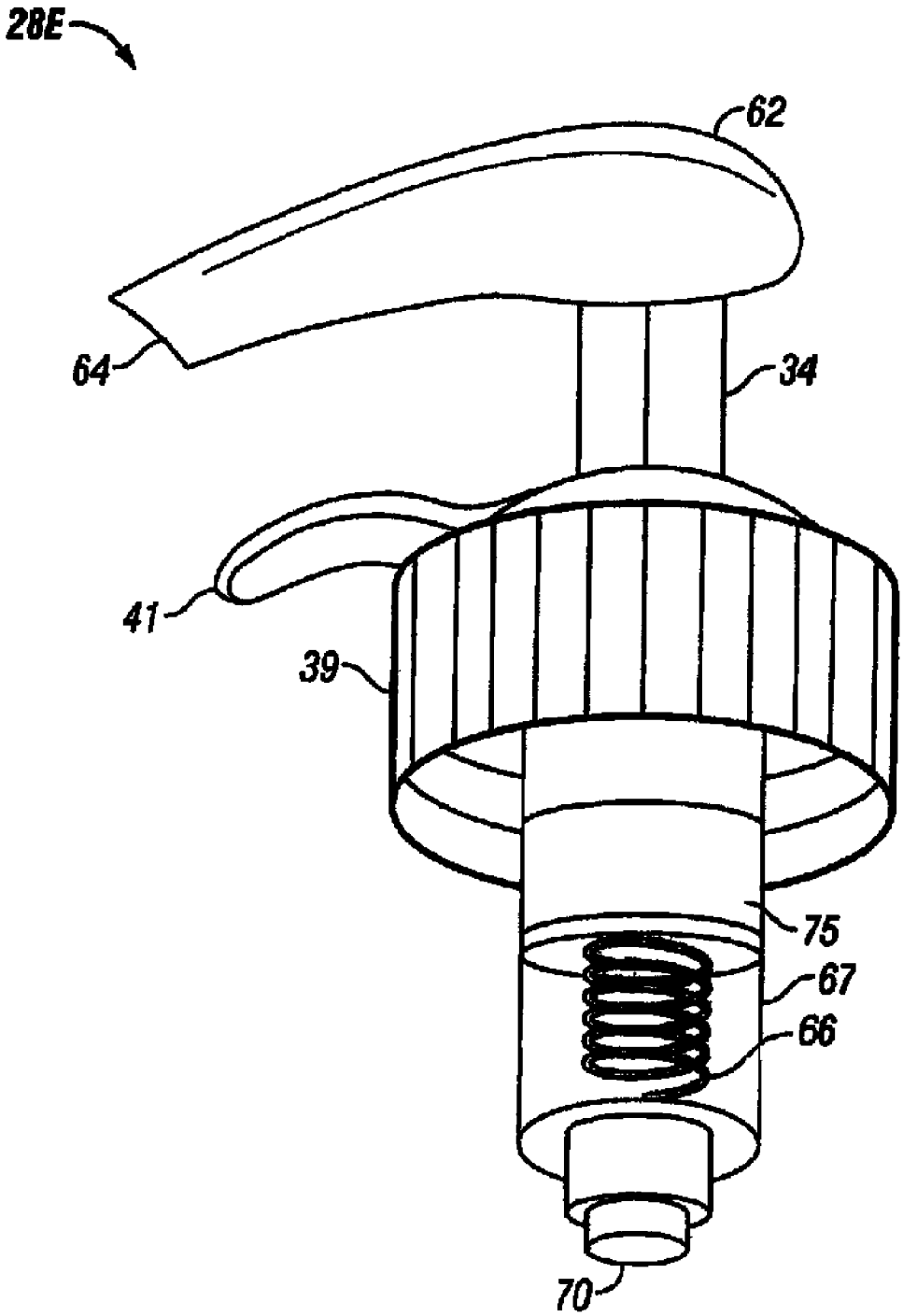
FIG. 5E is a perspective view of an adjustable output push pump illustrating a support member which can be added to the pump assembly to reduce forces on the dispenser body.

Referring to FIG. 5E, a push pump 28E includes a support member 41 is attached to cap member 39. The support member 41 serves to reduce pressure and forces on the other components of the dispenser as liquid is pumped from the dispenser. In one embodiment, the support member 41 is parallel with the pump head 62 and does not extend farther away from the neck 34 than the outlet 64 on the pump head 62. The support member cab be a part of the push pump or alternatingly can be molded into the body of the dispenser. The support member 41 and the pump head 62 can be squeezed together in a pinching action during the pumping process.

In a preferred embodiment of the present invention, the dispenser body has a conforming shape that allows it to fit snugly against various surfaces to which the liquid dispenser is mounted. The flexibility in mounting the liquid dispenser is further increased by providing the adjustable suction cups. Due to the conforming shape of the liquid dispenser, in at least some of the embodiments shown, the liquid dispenser can not rest freestanding on the bottom end of the liquid dispenser. Therefore, an adapter is also disclosed that can be used with the liquid dispenser for filling the liquid dispenser.

The adapter may be used with the embodiments shown or alternatively the adapter may be used with conventional designs of liquid containers. In addition, the adapter may be used to transfer liquid between the embodiments of liquid dispensers shown and conventional liquid containers.

Figure 6A:
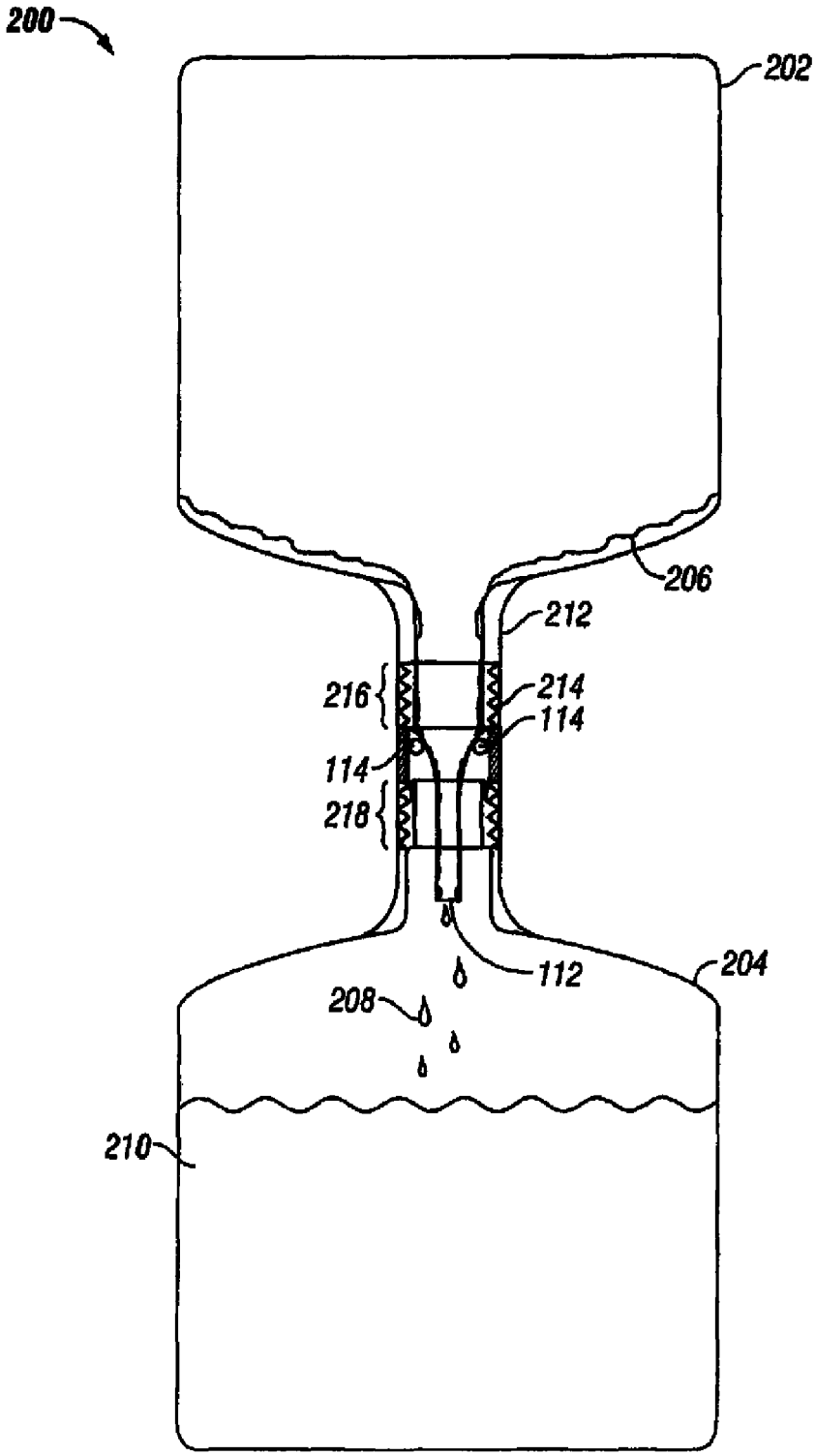
FIG. 6A illustrates one embodiment of a filling adapter according to one embodiment of the present invention.
Figure 6B:
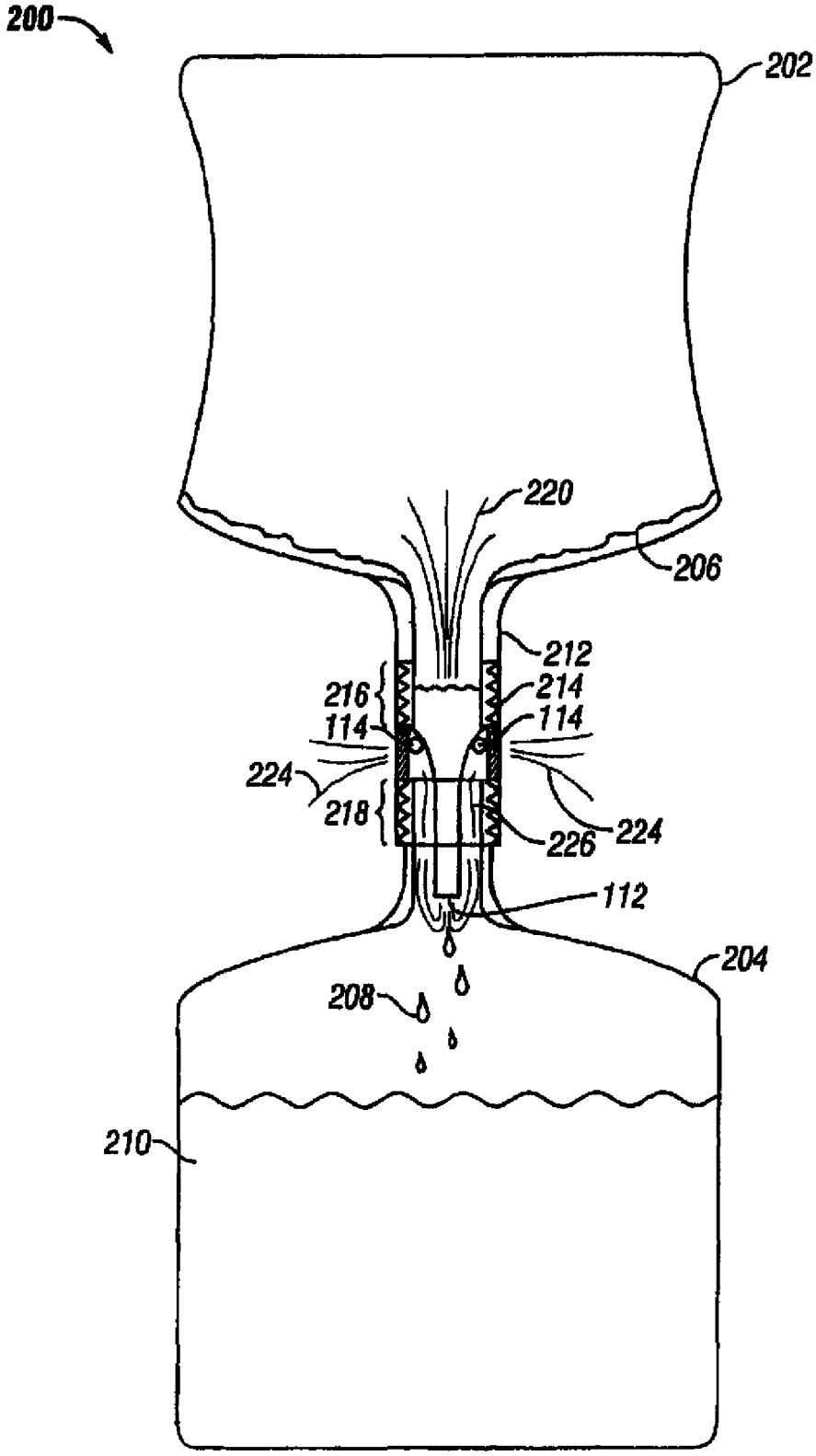
FIG. 6B illustrates the filling adapter of FIG. 6A as pressure is applied to a top container.

FIGS. 6A and 6B illustrate basic liquid transfer from one container to another. In FIG. 6A, a system 200 is shown with a first container 202 and a second container 204. The first container 202 has a liquid 206 such as a liquid soap. The first container 202 has a neck 212. There is an adapter 214 that connects the first container 202 with the second container 204. The adapter 214 has first and second opposite ends 216 and 218. Both first end 216 and the second end 218 are threaded to fit the first container 202 and the second container 204. The present invention contemplates that the adapter need not be threaded to fit the first container 202 and/or the second container 204. In the specific embodiment of the adapter 214 shown, there is a tube 116 that is inserted into the second container 204 and there are vents 114 for air 226 (shown in FIG. 6B) to improve liquid flow from the first container 202 to the second container 204. Liquid 206 and air 226 in the first container passes through the adapter and through opening 112 to form drops 208 or a stream of liquid that are added to the liquid 210 in the second container 204 access air 224 and recovery (expansion air) pass in and out through vents 114. In FIG. 6B, air 220 helps aid in the flow of the liquid.

FIGS. 7-20 illustrate various embodiments of an adapter that can be used with the dispenser of the present invention. The adapters can be inserted into the dispenser body and then a liquid container, such as a bottle of soap. This allows the liquid container to be connected to the liquid dispenser body so that the dispenser can be refilled with liquid in a manner that is clean and efficient and to reduce the amount of wasted liquid that is left in the container.

Figure 7:
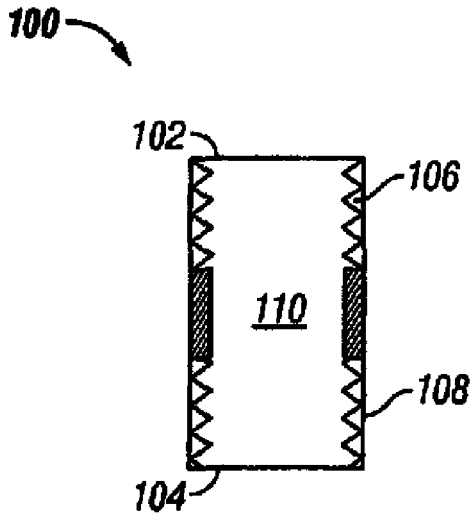
FIG. 7 is a sectional view of one embodiment of a filling adapter of the present invention where both ends of the adapter are threaded.

For example, in FIG. 7, the adapter 100 has an adapter body 110 which includes a top end 102 and a bottom end 104. The top end includes threads 106 for fitting on a container of liquid and the bottom end includes threads 108 for fitting on another container of liquid.

Figure 8:
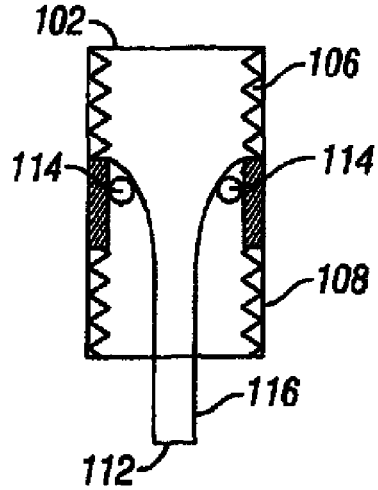
FIG. 8 is a sectional view of another embodiment of a filling adapter of the present invention where both ends of the adapter are threaded, there is a tube for funneling liquid flow and there are air openings.

FIG. 8 illustrates another embodiment of an adapter. In FIG. 8, there are air passages 114 to encourage flow of liquid from a container fastened to the top end 102 to the container that is being filled. There is also a tube 116 with an outlet 112. The tube 116 and outlet 112 extend into the container that is being filled. This configuration reduces any likelihood of mess and the presence of the air passages 114 encourage the flow of liquid. Air passages 114 allow the filling container to be compressed and released to aid in the complete transfer of contents as shown in perspective FIGS. 6A and 6B.

Figure 9:
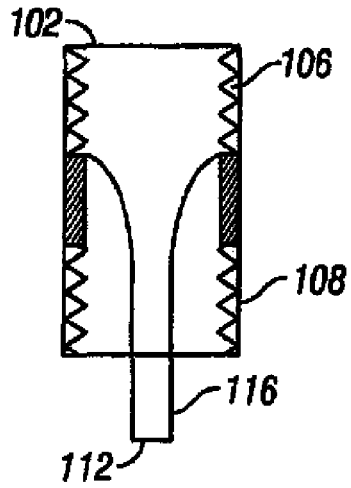
FIG. 9 is a sectional view of another embodiment of a filling adapter of the present invention where both ends of the adapter are threaded and there is a tube for funneling liquid flow.
Figure 10:
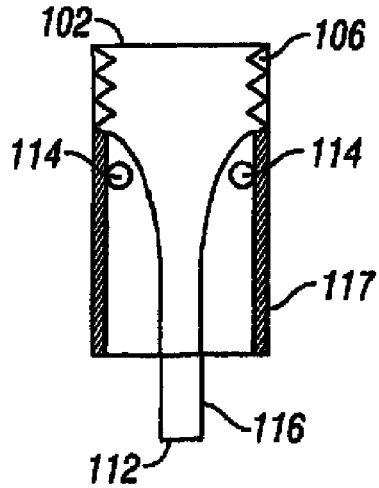
FIG. 10 is a sectional view of another embodiment of a filling adapter of the present invention where one end is threaded, there is a tube for funneling liquid flow and there are air openings.
Figure 11:
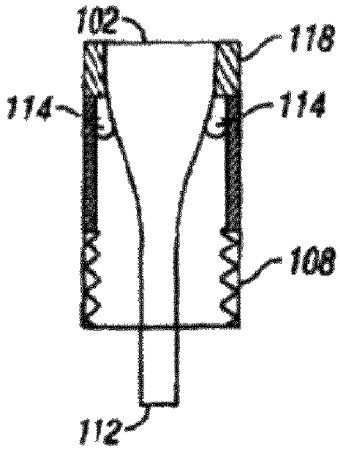
FIG. 11 is a sectional view of another embodiment of a filling adapter of the present invention where one end is threaded, there is a tube for funneling liquid flow and there are air openings.
Figure 12:
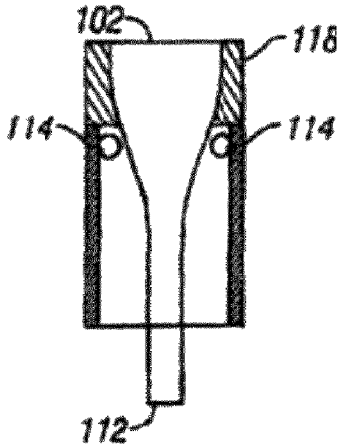
FIG. 12 is a sectional view of another embodiment of a filling adapter of the present invention where there is a tube for funneling liquid flow and there are air openings.
Figure 13A:
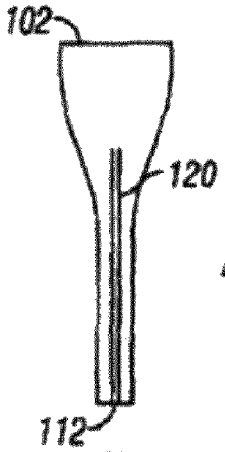
FIG. 13A is a sectional view of another embodiment of a filling adapter of the present invention.
Figure 13B:
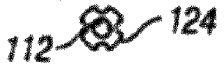
FIG. 13B is an end view of the tube in FIG. 13A.

FIG. 9 illustrates another embodiment of the adapter. In FIG. 9, however, there are not air passages present. FIG. 10 illustrates another embodiment of the present invention. In FIG. 10, there is a smooth surface 117 on the bottom end of the adaptor. FIG. 11 illustrates another embodiment of an adapter according to the present invention. In FIG. 11, there is a smooth surface 118 on the top end of the device, there are air passages 114 present, and the adapter includes an outlet 112 that would extend into the container that is being filled. FIG. 12 illustrates another embodiment without threads on either end. FIGS. 13A and 13B illustrate another embodiment that includes one or more vent channels 120. The vent channels 120 which can be of various size apertures, allow internal air to leave the container while filling, eliminating blow back. The shape of the channels is shown as 124.

Figure 14:
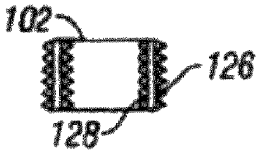
FIG. 14 is a sectional view of another embodiment of a filling adapter of the present invention which is threaded.
Figure 15:
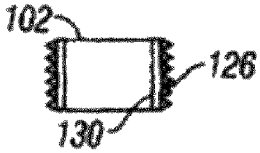
FIG. 15 is a sectional view of another embodiment of a filling adapter of the present invention which is threaded.
Figure 16:
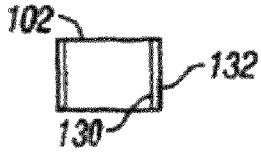
FIG. 16 is a sectional view of another embodiment of a filling adapter of the present invention.

FIGS. 14-16 illustrate additional embodiments of the adapter of the present invention. In FIG. 14, the outer wall 126 of the adapter is threaded and the inner wall 128 is threaded. In FIG. 15, the outer wall 126 is threaded while the inner wall 130 is smooth. In FIG. 16, the inner wall 130 is smooth and the outer wall 132 is also smooth. FIGS. 14-16 allow more universal adaptation of FIGS. 7-13B and FIG. 17 to different size containers.

Figure 17:
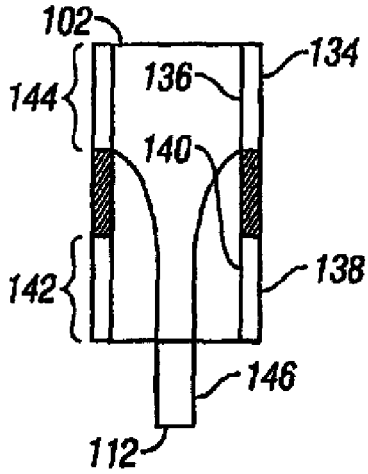
FIG. 17 is a sectional view of another embodiment of a filling adapter of the present invention that includes a tube to funnel liquid.

FIG. 17 illustrates another embodiment of the adapter of the present invention where both the top end 144 and bottom end 142 are smooth. There is a tube 146 with an opening 112 for fitting within the container to which liquid is transferred. The top end 144 has a smooth inner wall 136 and a smooth outer wall 134. The bottom end 142 of the container has a smooth inner wall 140 and a smooth outer wall 138.

Figure 18:
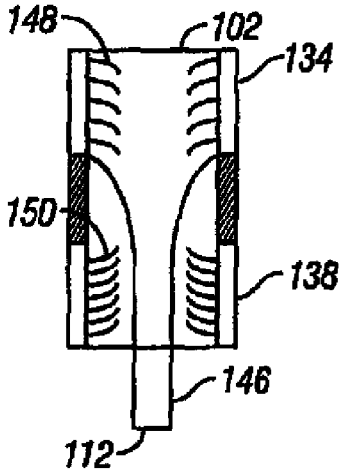
FIG. 18 is a sectional view of another embodiment of a filling adapter of the present invention that includes a tube to funnel liquid and flexible barbed rows.
Figure 19:
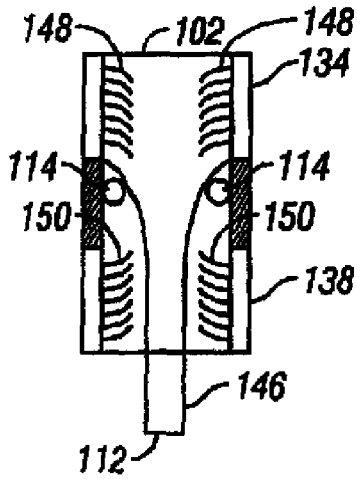
FIG. 19 is a sectional view of another embodiment of a filling adapter of the present invention that includes a tube to funnel liquid and flexible barbed rows and there are air openings.
Figure 20:
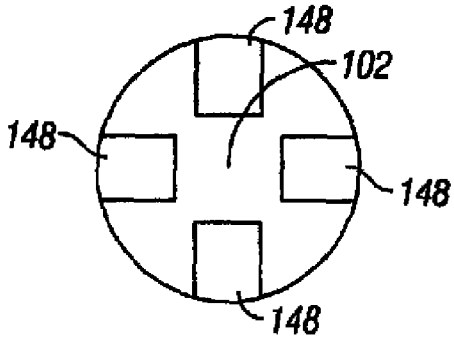
FIG. 20 is top view of an opening in the filling adapter showing the flexible barbed rows.

FIGS. 18-20 illustrate various embodiments of the adapter of the present invention where barbed rows 148 and 150 are used. The barbed rows allow a more conforming fit to the threads associated with the first container and/or second container to which the adapter is connected. The barbed rows 148 are orientated generally opposite of the orientation of barbed rows 150. FIG. 20 illustrates a top view showing flexible barbs 148. These multiple vertical rows of flexible barbed material enable a user to push the adapter onto the threaded neck of containers of various sizes. When transfer is complete, the adapter can be unscrewed from each container.

Figure 21:
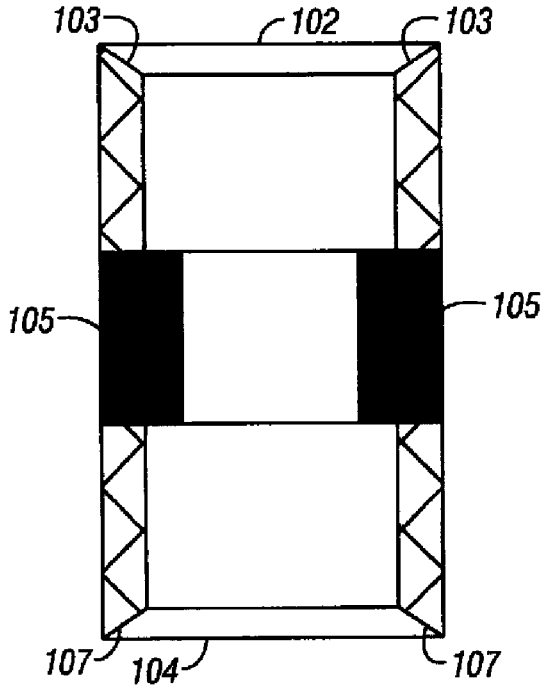
FIG. 21 is another embodiment of a filling adapter of the present invention.

FIG. 21 illustrates another embodiment of an adapter. The adapter has a top end 102 and a bottom end 104. Top end side walls 103, 107 form a body on opposite ends of a central member 105, which defines a non-tapered tube or orifice. The tapered sidewalls 103, 107 make the adapter universal to better accommodate container openings. The container openings may use threads, barbs, raised rings, ribs, or alternative structures to assist in connecting containers. In addition, the tapered side walls are preferably made of a flexible rubber or other material to better accommodate different sized container openings.

Figure 22:
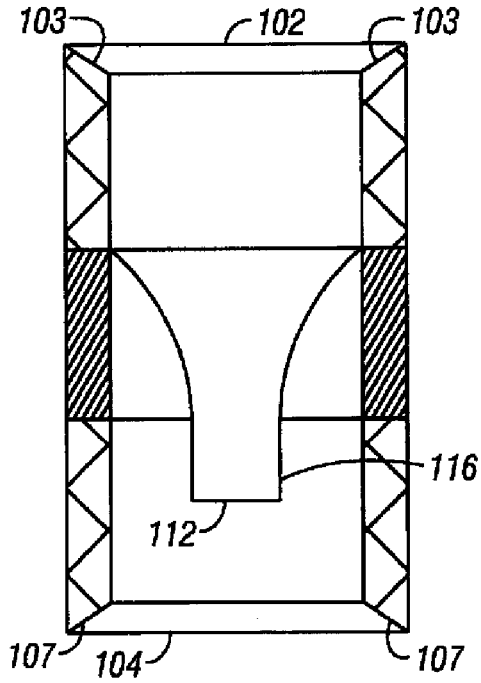
FIG. 22 is another embodiment of a filling adapter.

FIG. 22 illustrates another embodiment of an adapter. The adapter has a top end 102 and a bottom end 104. A tube 116 with an outlet 112 extend into a receiving container. Note that an adapter such as that shown in FIG. 22, the bottom end 104 is a receiving end. The sidewall 107 is color coded (such as green) to indicate that the end 104 is the receiving end. Alternatively, the side wall 107 may have an arrow pointed downward to indicate that the bottom end 104 is the receiving end, or other indicia related to the functionality of the device.

Figure 23:
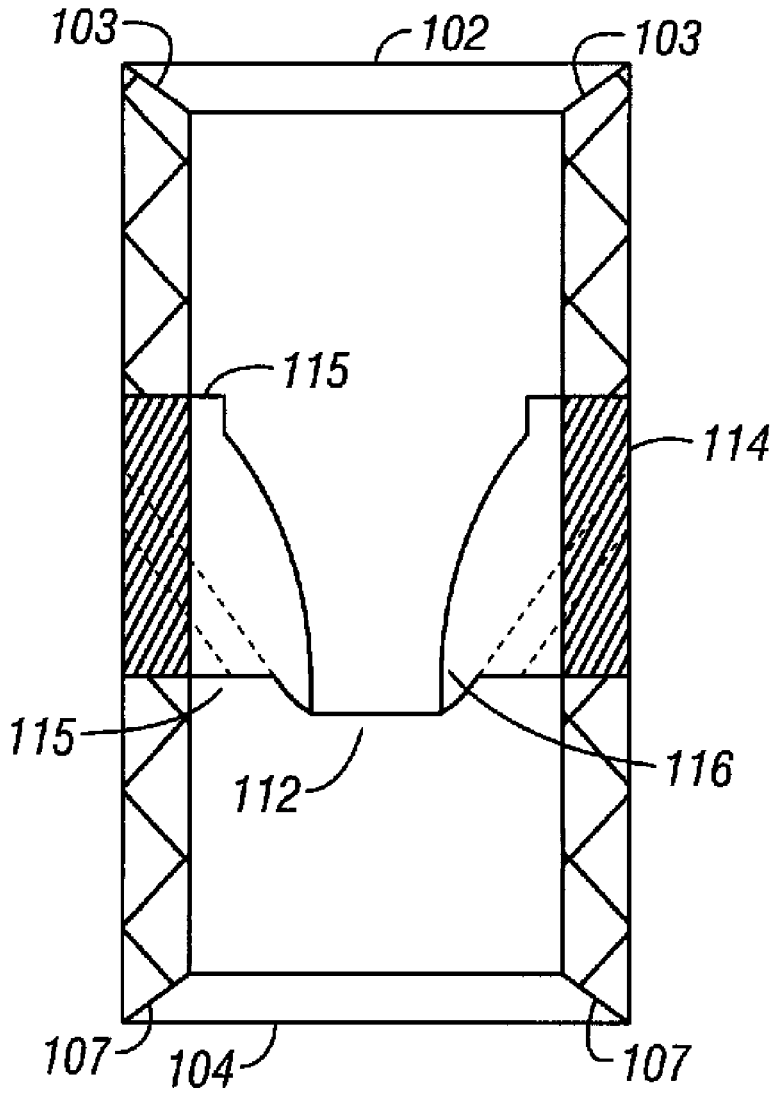
FIG. 23 is another embodiment of a filling adapter.

FIG. 23 illustrates another embodiment of an adapter. If the receiving container is configured so as to not allow the tube 116 to be inserted, such as by having a restricted or small opening, a shorter tube 116 may be used which would allow the tube 116 to align and contact the restricted opening of the receiving container. The adapter has a top end 102 and a bottom end 104. Not that the adapter shown in FIG. 23 uses the bottom end 104 as a receiving end. The sidewall 107 may be color coded (such as being colored green) to indicate that the end 104 is the receiving end. Alternatively, the side wall may have an arrow pointed downward to indicate that the bottom end 104 is the receiving end, or other indicia related to the functionality of the device. The tube 116 and/or orifice 112 keep the transferred liquid away from the receiving container's neck seat 115, eliminating leaking of transferred material outside the container. While applying forces to the transferring container, tube 116 may also be used to increase the velocity and help induct the liquid from the transferring container and direct the flow into the receiving container for a faster and/or more complete transfer.

The present invention includes the methodology of filling a container that is being filled. According to the methodology, preferably, the top end 102 of the adapter is placed onto the open end of a liquid container. The opposite end of an adapter is placed within the container that is being filled. The liquid container is positioned above the container that is being filled such that liquid within the liquid container flows downward, from the liquid container and into the container that is being filled. This allows emptying the liquid container while minimizing or eliminating the spillage. In addition, the present invention contemplates that because the adapter is secured to the container being filled and the liquid container, a person need not oversee this process. When the liquid within the liquid container is thick or slow pouring and the liquid container is nearly empty, it may take a significant amount of time to drain the liquid container. Once the containers are manually connected, forces can be applied to help expedite the full transfer of liquids while maintaining complete container to container contact. Because a person does not need to hold the liquid container to empty it and does not need to monitor the emptying process, this aspect of the invention provides additional convenience and increases the likelihood that the liquid container is fully drained.

The present invention also contemplates that the adapters can have different size fittings on either end of the tube to matingly connect containers of different sizes. The present invention includes the methodology of filling a container.

It should also be appreciated that certain benefits are derived from using the liquid dispenser with the adapter. For example, when the body of liquid dispenser is conformingly shaped it may not be capable of being freestanding on the bottom end as there is no substantially flat bottom surface. In such a case, the adapter aids in filling the liquid dispenser. The present invention contemplates that the liquid dispenser need not even be removed from where it is mounted. Rather, the push pump can be removed and the liquid dispenser can be filled using the adapter to connect the liquid dispenser to another container of liquid.

The liquid dispenser can also be packaged with one or more sets of removable mounts such as suction cups to mount the liquid dispenser to various surfaces. The liquid dispenser and the accompanying adapter are preferably comprised of a dishwasher safe material to aid in cleaning and sanitizing between uses.

The present invention contemplates numerous variations in materials used, configurations, shapes, sizes, and other variations within the scope of the invention now claimed.

What is claimed is:

1. A filling adapter for conveying liquid from a first liquid container to a second liquid container, the adapter comprising:
   - an adapter body having a top end and an opposite bottom end being generally cylindrical in shape;
   - the top end adapted for fitting an opening in the first liquid container;
   - the bottom end adapted for fitting an opening in the second liquid container;
   - an open path in the adapter body from the top end to a tube at the bottom end for communicating liquid from the opening in the first liquid container to the opening in the second liquid container; the open path being funnel shaped; wherein the tube is configured to vent air from the second liquid container.

2. The filling adapter of claim 1 further comprising threads and the adapter body on the top end for threadably connecting the adapter to the first liquid container.

3. The filling adapter of claim 2 further comprising threads and the adapter body on the bottom end for threadably connecting the adapter to the second liquid container.

4. The filling adapter of claim 1 wherein the tube extends beyond the bottom end.

5. The filling adaptor of claim 4 wherein the tube extends partially into the opening in the second liquid container and not beyond the bottom end.

6. The filling adapter of claim 1 wherein the filling adapter being marked with indicia indicative of correct orientation of the filling adapter.

7. The filling adapter of claim 1 further comprising at least one vent hole in the adapter body.

8. The filling adapter of claim 1 further comprising raised ribs disposed on an inside surface of the top end.

9. The filling adapter of claim 1 further comprising raised ribs disposed on an inside surface of the bottom end.

10. The filling adapter of claim 1 wherein the tube comprises a plurality of vent channels along an outside surface of the tube.

11. The filling adapter of claim 1 wherein a sidewall of the top end being tapered.

12. The filling adapter of claim 11 wherein a sidewall of the bottom end being tapered.

13. The filling adapter of claim 1 wherein the top end being formed of a flexible material.

14. The filling adapter of claim 13 wherein the bottom end being formed of a flexible material.

15. The filling adapter of claim 1 further comprising flexible barbs disposed on the inside of the top end.

16. The filling adapter of claim 1 further comprising flexible barbs disposed on the inside of the bottom end.

17. The filling adapter of claim 1 further comprising at least one vent hole in the adapter body and positioned to vent air from the second liquid container.

18. The filling adapter of claim 1 further comprising a plurality of vent holes for venting air from the second liquid container.

19. The filling adapter of claim 1 further comprising a plurality of vent channels along the tube for venting air from the second liquid container.

20. A system for recovering liquid, comprising:
   - a liquid container comprising a body having an inner cavity for containing the liquid and an aperture providing access to the inner cavity;
   - a filling adapter for filling the liquid dispenser, the filling adapter comprising a first end adapted for fitting to the aperture of the liquid container and a second end adapter for fitting to an opening of a second liquid container, and an open path in the filling adapted from the first end to a tube at the second end for communicating liquid from the opening in the first liquid container to the opening in the second liquid container;

wherein the filling adapter is generally cylindrical in shape; the open path being funnel shaped; wherein the tube is configured to vent air from the second liquid container.

21. The system of claim 20 wherein the liquid container is a liquid dispenser.

22. The system of claim 20 wherein the filling adapter comprises a tube extending from the first end to the second end.

23. The system of claim 22 wherein the filling adapter further comprises a vent hole.

24. The system of claim 20 wherein the liquid container is not freestanding and adapted for connection to a wall.

25. The system of claim 20 wherein the first end of the filling adapter comprises a plurality of threads.

26. The system of claim 20 wherein the second end of the filling adapter comprises a plurality of threads.

27. The system of claim 20 wherein the filling adapter further comprises a plurality of raised ribs on an inside surface of the first end.

28. The system of claim 20 wherein the filling adapter further comprises a plurality of raised ribs on an inside surface of the second end.

29. The system of claim 20 wherein the filling adapter being marked with indicia indicative of correct orientation of the filling adapter.

30. The system of claim 20 wherein a sidewall of the top end being tapered.

31. The system of claim 20 wherein a sidewall of the bottom end being tapered.

32. The system of claim 20 wherein the top end being formed of a flexible material.

33. The system of claim 20 wherein the bottom end being formed of a flexible material.

34. The system of claim 20 further comprising flexible barbs disposed on an inside surface of the top end.

35. The system of claim 20 further comprising flexible barbs disposed on an inside surface of the bottom end.

36. The system of claim 20 wherein the filling adapter further comprises at least one vent hole in the adapter body and positioned to vent air from the second liquid container.

37. The system of claim 20 wherein the filling adapter further comprises a plurality of vent holes for venting air from the second liquid container.

38. The system of claim 20 wherein the filling adapter further comprises a plurality of vent channels along the tube for venting air from the second liquid container.

* * * * *

UNITED STATES PATENT AND TRADEMARK OFFICE

CERTIFICATE OF CORRECTION

PATENT NO. : 8,251,110 B2
APPLICATION NO. : 12/127335
DATED : August 28, 2012
INVENTOR(S) : Wade M. Bassett et al.

It is certified that error appears in the above-identified patent and that said Letters Patent is hereby corrected as shown below:

Column 10, Claim 1, Line 6:
after "end" insert -- and --.

Signed and Sealed this
Twentieth Day of November, 2012

David J. Kappos

David J. Kappos
*Director of the United States Patent and Trademark Office*